US006532669B1

(12) United States Patent
Starrett

(10) Patent No.: US 6,532,669 B1
(45) Date of Patent: Mar. 18, 2003

(54) CUTTING DEVICE

(76) Inventor: Paul D. Starrett, 256 Gilson Rd., Jaffrey, NH (US) 03452

( * ) Notice: Subject to any disclaimer, the term of this patent is extended or adjusted under 35 U.S.C. 154(b) by 0 days.

(21) Appl. No.: 09/698,321

(22) Filed: Oct. 27, 2000

(51) Int. Cl.[7] ..... B26B 29/00
(52) U.S. Cl. ..... 30/286; 30/253; 83/435.19
(58) Field of Search ..... 30/286, 287, 258, 30/253, DIG. 3; 83/435.19

(56) References Cited

U.S. PATENT DOCUMENTS 4,336,652 A * 6/1982 Robertson ..... 30/258

OTHER PUBLICATIONS

Monadnock Product Catalog, 1997, pp. 31.

* cited by examiner

*Primary Examiner*—Douglas D. Watts
(74) *Attorney, Agent, or Firm*—Ernest V. Linek; Banner & Witcoff, Ltd.

(57) ABSTRACT

A cutting device comprising a base, a pivot thruster, and a cutting blade is disclosed. The cutting device allows for safe cutting, and, unlike other cutting devices, may not be used as a weapon. The cutting device is lightweight, inexpensive, portable, and may be operated using one hand.

11 Claims, 4 Drawing Sheets

CUTTING DEVICE

BACKGROUND OF THE INVENTION

1. Field of Invention

This invention relates to a cutting device. Specifically, the device may be used to cut objects, including straps, ties, and paper, without the risk of injury to the operator.

2. Background

There are many situations where one needs to cut an object, such as a strap or tie, and must have reliability and safety. One example is the need to cut a plastic or nylon handcuff with safety for the user, such as a police officer, and safety for the subject, the person wearing the handcuffs. Another example is the need to cut plastic wire ties with safety for the person doing the cutting. Another example is the cutting of cardboard lids when opening cardboard boxes. Another example is the cutting of nylon or plastic banding material that is used by the shipping and packaging industry for palletizing materials together. In these situations, the user is better off with a cutter that provides full safety.

Current cutters usually consist of a handle and an open exposed razor blade. Many of these devices are formed of several shells that are hollow and are fixed to each other to form a hollow handle. The hinge is usually provided at one end of the shells while a blade mounting is arranged at the opposite end. The blade mounting holds a knife or razor blade so that it partially protrudes from the handle. Several of these devices are described in U.S. Pat. Nos. 6,131,292 and 6,122,828.

The utility knives described in these patents and other cutters pose potential risk to the operator such as accidental cutting of the operator's hand. In the case of the cutting plastic handcuffs off a subject, current cutters pose risk to the subject, including accidental cutting of the subject's hand, and also pose risk to the police officer since the cutter might be used as a weapon against the police officer. Rather than the types of cutters used now which do not have fully protected guards to prevent accidents, a cutter is needed that provides safe cutting and provides a protected guard so that the cutter may not be used as a weapon.

SUMMARY OF THE INVENTION

Now there is provided by the present invention a cutting device for cutting objects. The cutting device may be safely used by an operator, such as a policeman cutting plastic handcuffs, and may not be used as a weapon against the operator.

It is therefore a principal object of the present invention to provide a cutting device that aids an operator in safely cutting objects. These objects may include but are not limited to metal and plastic straps, metal and plastic ties, plastic handcuffs, paper straps, paper ties, tape, plastic wire, metal wire, rope, and fishing line. The device is light, portable and inexpensive.

One embodiment of the cutting device comprises a base, a pivot thruster attached to the base, and a cutting blade molded into the base. Opening of the pivot thruster allows for insertion of an object to be cut such as a plastic strip. The opening is not large enough, however, to use the cutting blade as a weapon. Insertion of the object to be cut, followed by closing of the pivot thruster results in safe cutting of the object.

A second embodiment of the cutting device comprises a base, a pivot thruster attached to the base, a cutting blade molded into the base, and a projection located on the base. Operation of the second embodiment is similar to the first embodiment described hereinabove. The projection located on the base acts to split the cut object. This embodiment is well suited to the cutting of cardboard such as when opening the lids of cardboard boxes. Other aspects of the invention are disclosed below.

BRIEF DESCRIPTION OF THE DRAWINGS

These and other features and advantages of the present invention will become more apparent in view of the following detailed description in conjunction with the accompanying drawing, of which.

DETAILED DESCRIPTION OF THE PREFERRED EMBODIMENTS

The preferred embodiments of the present invention will be described herein with reference to two illustrative embodiments of a cutting device which have been designed to cut plastic handcuffs such as those described in the following patents; U.S. Pat. No. 6,101,682, U.S. Pat. No. 6,026,661, U.S. Pat. No. 5,802,888, U.S. Pat. No. 5,443,155, U.S. Pat. No. 5,398,383, U.S. Pat. No. 5,193,254, U.S. Pat. No. 5,159,728, U.S. Pat. No. 4,910,831, and others. As set forth above, these cutting devices may also be used to cut numerous other objects, all in a safe and simple manner.

Figure 1:
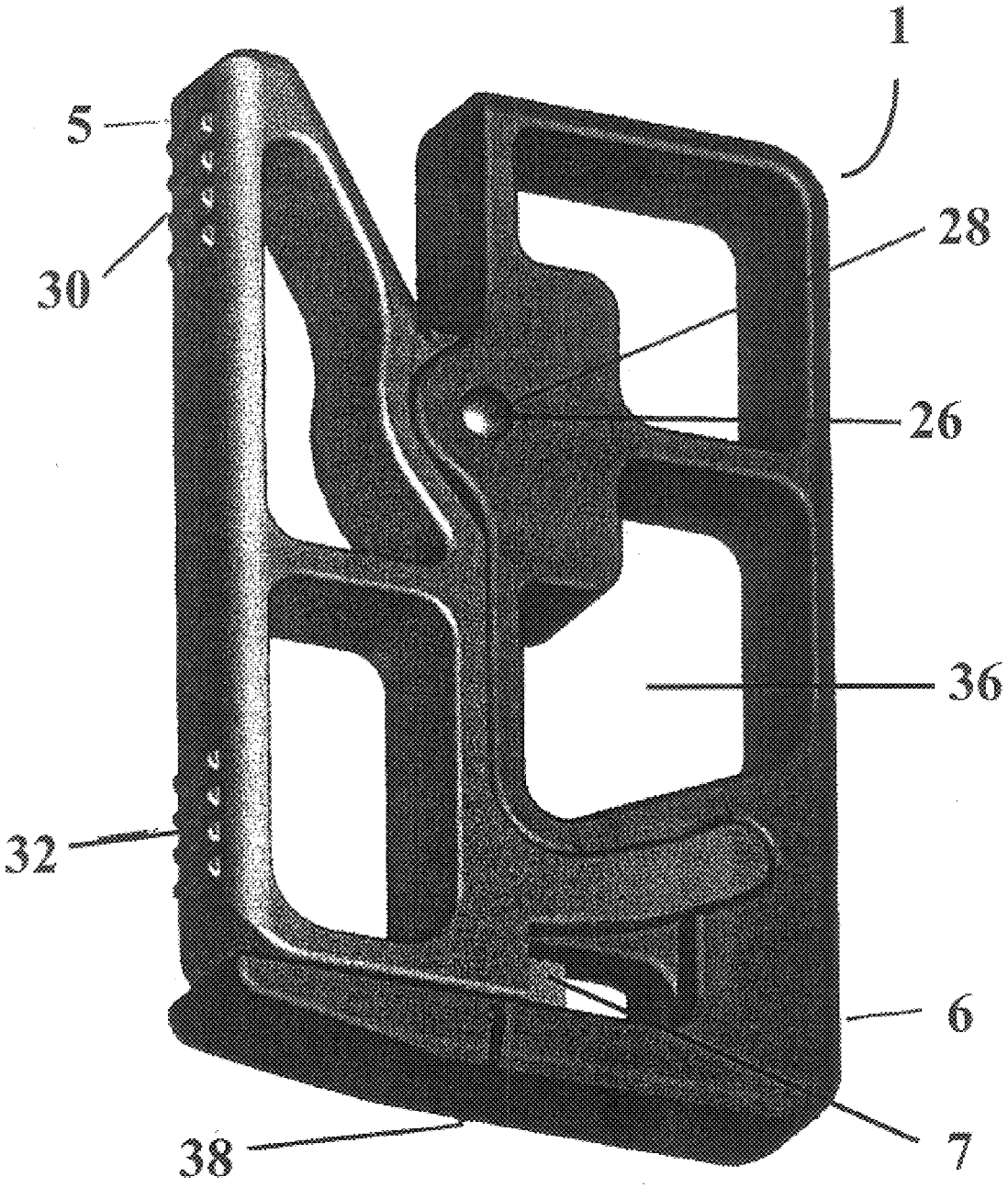
FIG. 1 shows an embodiment of the cutting device of the present invention in the closed position.

Referring to FIG. 1, there is shown the cutting device of the present invention generally referred to as numeral 1. The cutting device may be molded out of numerous materials. Preferably the cutting device is molded out of a strong plastic such as polycarbonate or reinforced nylon since these materials are both light and durable. Other materials, e.g., metals, composites, and the like may be used for all or a portion of the elements of these cutting devices.

The illustrated cutting device comprises a pivot thruster 5, a base 6, and a cutting blade 7, such as a razor or knife blade, molded into the base 6. The cutting blade 7 may be made of sharpened plastic, metal, or any other material capable of cutting. Preferably, the cutting blade is made of carbon steel and is thin. Most preferably the blade is carbon steel that is from about 0.010 to 0.012 inches thick.

Figure 2:
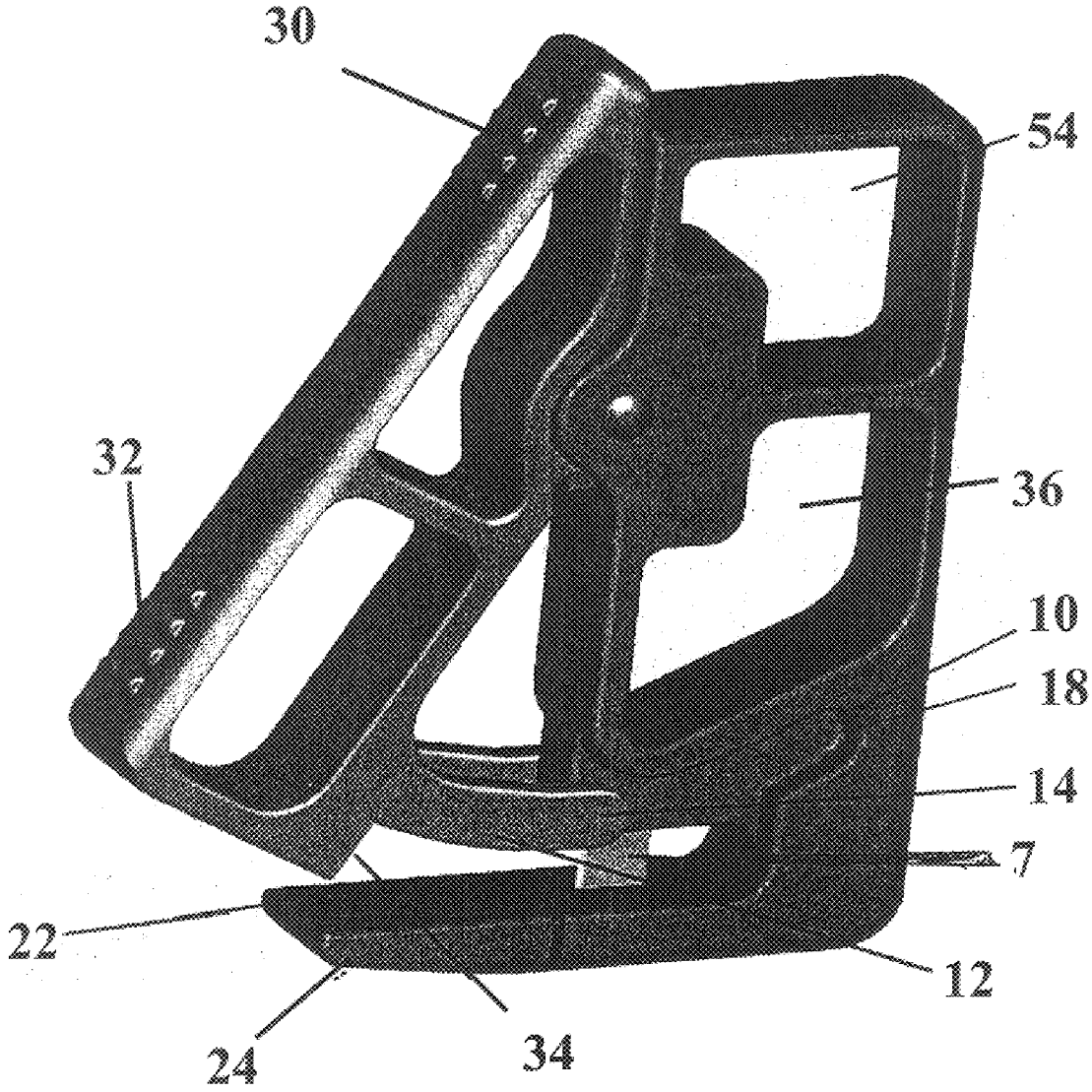
FIG. 2 shows an embodiment of the cutting device of the present invention in the open position.

Referring to FIG. 2, the base 6 comprises a locking slot 10 that receives and supports the retaining guard 12 of the pivot thruster 5. The base 6 also has an open stop indent 14 and an indent knob 16, which is located on the inside of the retaining guard 12, that locks the assembly open when the indent knob 16 contacts the open stop indent 14. The base 6 has a closed stop indent 18 and a locking slot 10 that are used to lock the pivot thruster 5 to the base 6 when the indent knob 16 contacts the closed stop indent 18. The base 6 further comprises a cutting slot 22 which receives the object to be cut. The object to be cut may be any object but is preferably a metal or plastic strap or tie. The base has a blade guard 24 that prevents accidental injury to the operator.

Referring to FIG. 1, the pivot thruster 5 is attached to the base 6 using a pivot thruster pin 26. The base 6 has a pivot thruster bushing 28 that receives the pivot thruster pin 24.

The pivot thruster 5 has two finger-ribbed areas 30 and 32 and rotates on the pivot thruster pin 26 to open and to close the pivot thruster for cutting. Referring to FIG. 2, the pivot thruster has a retaining guard 12 which holds the object to be cut in position and guards the cutting blade 7 for safety. The pivot thruster 5 also has a thrust face 34 that pushes the object into the blade.

The dimensions of the cutting device are preferably small enough to operate the cutting device using one hand. Most preferably, the overall size of the cutter is approximately 2 inches wide×3 inches tall×⅜ inches thick.

During operation of the cutting device, an operator would insert one or more fingers of one hand through the holding cavity 36 and use other fingers of the same hand to close the pivot thruster 5 using the cutting finger ribs 32 (see FIG. 1). The cutting device is reopened in a similar manner by pressure on the open finger ribs 30.

The cutting device works by sliding the cutting slot 22 onto the object to be cut. For example, squeezing the open finger ribs 30 on the pivot thruster 5 opens the cutting device. The cutting slot 22 may then be slid onto an object. The object may be held in the upward position or downward position prior to cutting. The operator then pulls the pivot thruster 5 toward the base 6 using the cutting finger ribs 32 to cut the object. To prevent one from cutting themselves, the cutting blade 7 is protected by the blade guard 24, the thrust face 34, and the retaining guard 16. The blade guard 24 has a break away slot 38 so that one may not break the blade guard 24 and use the cutter as an open blade weapon.

In a preferred embodiment, the cutting device is used to cut plastic handcuffs off a subject. The cutting device may be opened, as described hereinabove, by pressing the open finger ribs 30 on the pivot thruster 5. The plastic handcuffs may be slid into the cutting slot 22 of the cutting device. Pressing the cutting finger ribs 32 of the pivot thruster 5 then closes the cutting device. The plastic handcuffs are cut when the plastic contacts the cutting blade 7. When used in this manner, the cutting device provides a safe way to remove plastic handcuffs from subjects without the risk of harming the subjects. Additionally, the break away slot 38 of the blade guard 24 prevents the subject from using the cutting device as a weapon against an individual such as a police officer.

Figure 3:
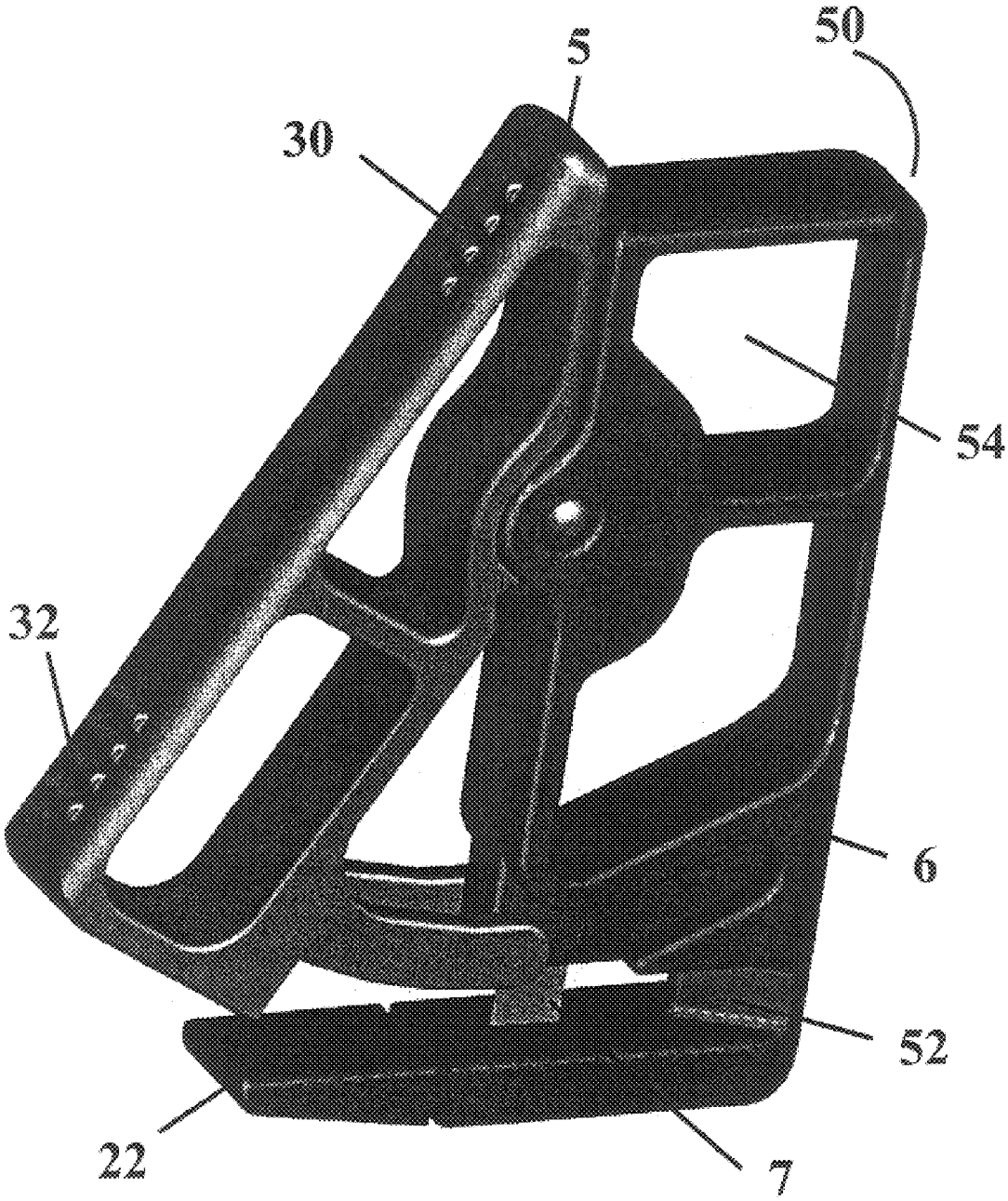
FIG. 3 shows a second embodiment of the cutting device of the present invention in the open position.
Figure 4:
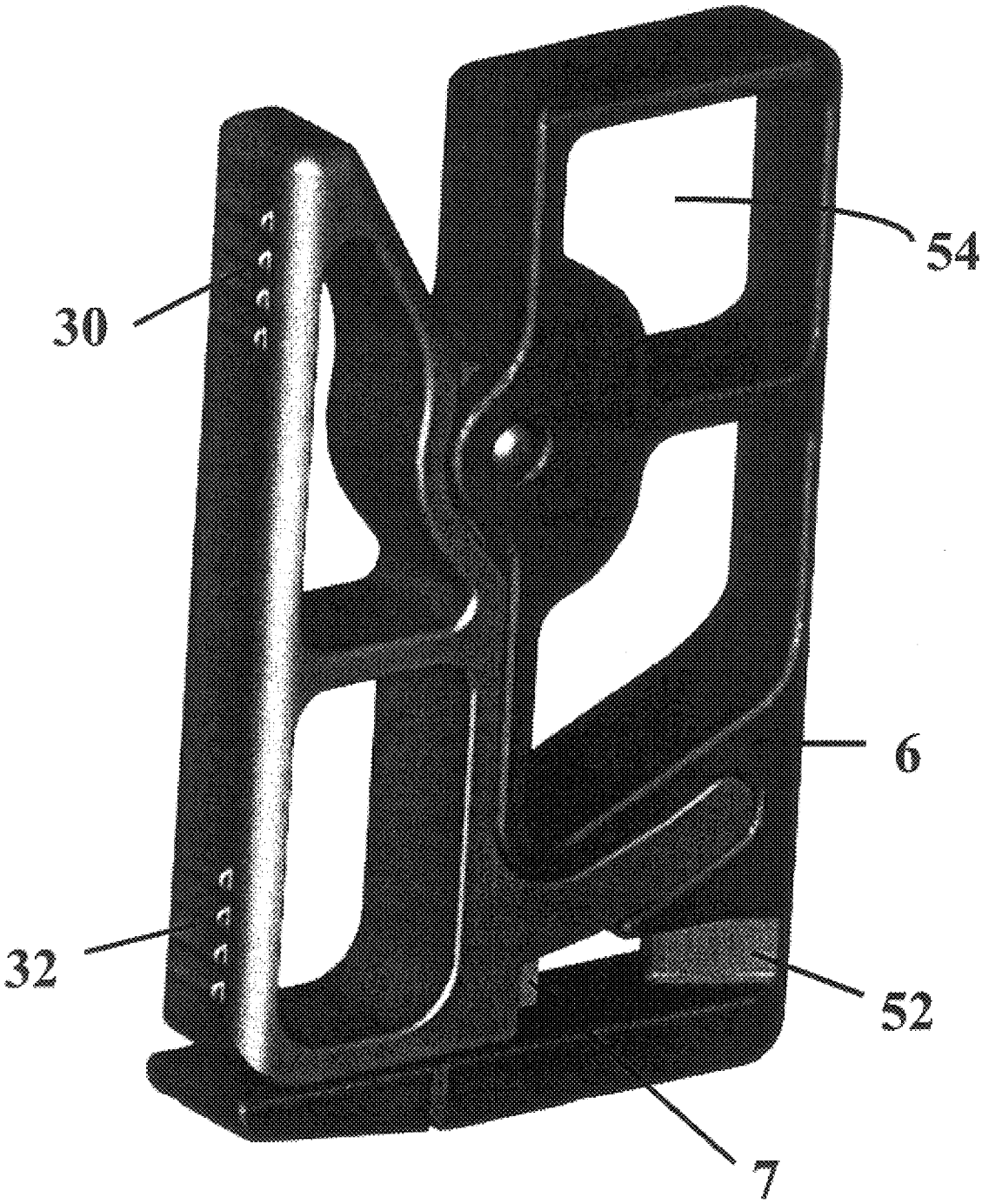
FIG. 4 shows a second embodiment of the cutting device of the present invention in the closed position.

Referring to FIG. 3, there is shown a second embodiment of the cutting device of the present invention generally referred to as numeral 50. This embodiment comprises all of the elements of the cutting device described hereinabove with the addition of a projection 52 to the base 6. This embodiment may be used for cutting plastic, but is preferably used for cutting objects such as paper, cardboard, or tape. For example, pressing the open finger ribs 30 on the pivot thruster 5 opens the cutting device. A piece of cardboard may then be inserted into the cutting slot 22. Pressing the cutting finger ribs 32 on the pivot thruster 5 closes the cutting device. As the cutting blade 7 cuts the piece of cardboard, the cutting device 50 may be opened, moved forward along the piece of cardboard, and closed again to cut the cardboard. The projection 52 acts to split or to separate the cardboard as the cutting device is moved forward over the cardboard (see FIG. 4). A similar procedure may be employed by using the cutting device to open taped boxes.

The cutting device is small, light, safe and develops great force to cut the strap easily. The cut-a-way sections provide a light cutting device that may be attached to a belt or key chain using the attaching cavity 54 (see FIGS. 2–4). These features, and the features described above, allow the cutting device to be used in multiple situations including cutting fishing line, piano wire, rope, electrical wiring, and the cutting of other objects that are normally cut with a utility knife.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A cutting device, comprising:

a pivot thruster, a base, and a cutting blade for cutting an object, the pivot thruster is connected to the base through a base pin bushing and a pivot thruster pin, and the cutting blade is molded into the base;

wherein the base comprises:

a closed stop indent cavity, an open stop indent cavity, a locking slot, and a blade guard.

2. The cutting device of claim 1, wherein the pivot thruster comprises:

open finger ribs, closed finger ribs, and an indent knob.

3. The cutting device of claim 1, wherein the cutting blade is preferably a razor blade or a knife blade.

4. The cutting device of claim 3, wherein the cutting blade is metal or plastic.

5. The cutting device of claim 3, wherein the cutting blade is preferably carbon steel that is 0.010 to 0.012 inches thick.

6. A cutting device, comprising:

a pivot thruster, a base, a cutting blade for cutting an object, and a projection located on the base for splitting the cut object, the pivot thruster is connected to the base through a base pin bushing and a pivot thruster pin, and the cutting blade is molded into the base.

7. The cutting device of claim 6, wherein the base comprises:

a closed stop indent cavity, an open stop indent cavity, a locking slot, and a blade guard.

8. The cutting device of claim 7, wherein the pivot thruster comprises:

open finger ribs, closed finger ribs, and an indent knob.

9. The cutting device of claim 6, wherein the cutting blade is preferably a razor blade and a knife blade.

10. The cutting device of claim 9, wherein the cutting blade is metal or plastic.

11. The cutting device of claim 9, wherein the cutting blade is carbon steel that is from about 0.010 to 0.012 inches thick.

* * * * *